US005421991A

United States Patent [19]

Yarita

[11] Patent Number: 5,421,991

[45] Date of Patent: * Jun. 6, 1995

[54] PLATINUM ALLOY ELECTRODEPOSITION BATH AND PROCESS FOR MANUFACTURING PLATINUM ALLOY ELECTRODEPOSITED PRODUCT USING THE SAME

[75] Inventor: Soumei Yarita, Kanagawa, Japan

[73] Assignee: Electroplating Engineers of Japan, Ltd., Japan

[ * ] Notice: The portion of the term of this patent subsequent to May 10, 2011 has been disclaimed.

[21] Appl. No.: 126,263

[22] Filed: Sep. 24, 1993

[51] Int. Cl.[6] ..... C25D 2/56

[52] U.S. Cl. ..... 205/257; 205/255

[58] Field of Search ..... 205/257, 264, 255

[56] References Cited

U.S. PATENT DOCUMENTS

| | | | |
|---|---|---|---|
| 4,377,450 | 3/1983 | Okinaka | 204/47 |
| 4,673,472 | 6/1987 | Morrissey et al. | 205/265 |
| 4,715,935 | 12/1987 | Lovie et al. | 205/265 |
| 5,310,475 | 5/1994 | Kitada et al. | 205/264 |

FOREIGN PATENT DOCUMENTS

| | | |
|---|---|---|
| 0465073A1 | 1/1992 | European Pat. Off. . |
| 7853 | 9/1895 | United Kingdom . |

OTHER PUBLICATIONS

Indira et al, "Addition Agent For Platinum Plating", Metal Finishing, May 1969, pp. 44–49.

Lowenheim F. A., "Electroplating", McGraw-Hill Co., New York, 1978, pp. 426–441.

Baumgärtner, M. E. and Raub, Ch.J., "The Electrodeposition of Platinum and Platinum Alloys", *Platinum Metals Rev.*, 32(4), pp. 188–197 (1988).

Angus, H. C., "Ontwikkelingen bij het elektrolytisch neerslaan van metalen uit de platinagroep", *International Nickel Ltd., London*, pp. 74–78.

Baumgärtner, M. E. et al., "Elektrolytisch adgeschiedene Platin-Kobalt-Legierungsschichten (Mechanische und magnetische Eigenschaften)", *Metalloberflache*, 41, pp. 559–563 (1987).

*Primary Examiner*—John Niebling
*Assistant Examiner*—Kishor Mayekar
*Attorney, Agent, or Firm*—Klauber & Jackson

[57] ABSTRACT

This invention provides a platinum alloy electrodeposition bath which, by alloying platinum with other metals, enables thick plating and can give platinum alloy layers having superior luster and hardness, and also provides a process for manufacturing a platinum alloy electrodeposited product using the same.

The platinum alloy electrodeposition bath according to this invention contains 2 to 100 g/lit. of platinum in the form of $Pt(OH)_6^{2-}$ complex ion and at least one of Sn, Zn and Pd in an amount of 1 mg/lit or more.

14 Claims, No Drawings

PLATINUM ALLOY ELECTRODEPOSITION BATH AND PROCESS FOR MANUFACTURING PLATINUM ALLOY ELECTRODEPOSITED PRODUCT USING THE SAME

BACKGROUND OF THE INVENTION

1. Field of the Invention

This invention relates to an electrodeposition bath of platinum alloy which has characteristics superior to that of pure platinum in terms of luster and high hardness and allows thick plating and to a process for manufacturing a platinum alloy electrodeposited product using the same.

2. Description of the Prior Art

Platinum is widely used as a noble metal material for decoration. Such decorative platinum are obtained using a known platinum plating bath, for example, as disclosed in Japanese Laid-Open Patent Publication No. Hei-2-107794.

However, such conventional platinum plating baths have problems in that they give deposits with lusterless appearance or low hardness, cannot achieve thick plating or has inconsistent deposition efficiency, and thus they are not very preferable for decoration. In addition, industrial use of such platinum plating has been limited to the fields such as electrodes manufacturing.

SUMMARY OF THE INVENTION

The present invention is to provide a platinum alloy electrodeposition bath employing no pure platinum but an alloy of platinum and other metals, whereby allowing thick plating, giving lustrous or high-hardness platinum alloy layers, and a process for manufacturing a platinum alloy electrodeposited product using the same.

In the preceding and following descriptions, the term "electrodeposition" is used as having a broad concept which includes electroplating and electro forming.

These and other objects of the invention will become more apparent upon a reading of the following detailed description and embodiments.

DESCRIPTION OF THE PREFERRED EMBODIMENTS

In order to achieve the above-mentioned objects, the platinum alloy electrodeposition bath according to this invention contains 2 to 100 g/lit. of platinum in the form of $Pt(OH)_6^{2-}$ complex ion and at least one of Sn, Zn and Pd in an amount of 1 mg/lit. or more.

In this case, Sn assumes a stable,state in the form of $Sn(OH)_6^{2-}$ and allows to give excellent platinum-tin alloy layers.

Further, Zn assumes a stable state if it is present in the bath in the form of $Zn(OH)_3^-$ or $Zn(OH)_4^{2-}$ and allows to give excellent platinum-zinc alloy layers.

Pd may be present in the electrodeposition bath in the form of $[Pd(NH_3)_2]^{2+}$, $[Pd(NH_3)_2X_4]^{2-}$ or $[Pd(NH_3)_4]^{2+}$, wherein X is a monovalent anion. Pd is stable when it is present in the bath in the form of complexion expressed by $[Pd(NH_3)n]^{2+}$, wherein n is 1 to 4. In this case, a halogen anion such as $I^-$, $B^-$, $Cl^-$ and $F^-$ may further be coordinated. Meanwhile, stability of Pd can further be increased by allowing amidosulfuric acid (sulfamic acid), potassium amidosulfate (potassium sulfamate) or sodium amidosulfate (sodium sulfamate) to be present in the electrodeposition bath.

If Pd is reacted with an oxidizing agent such as sodium peroxodisulfate and potassium peroxodisulfate prior to its addition to the electrodeposition bath, it can be present in the bath in a more stable state. Move stable complex ion can again be obtained by reacting it with a halogen ion in addition to $NH_3$.

Subsequent reactions may proceed beneficially if Pd is used in the form of salt such as $Pd(NH_3)_4Cl_2$, $Pd(NH_3)_2Cl_2$ and $Pd(NH_3)_4(OH)_2$. Addition of a carboxylic acid such as citric acid, oxalic acid, acetic acid, malic acid and tartaric acid or alkali metal salts of carboxylic acids to the bath effectively served to improve uniformity in the appearance of the deposits, to prevent cracking or to stabilize the bath.

Although not so conspicuous as in the ease of carboxylic acids, addition of an alkali metal salt of sulfuric acid or phosphoric acid brought about the same effects.

Referring to operational conditions, while DC power supply can of course be employed, a pulse power supply may be used to vary the electrodeposit composition and to make the metal layer appearance smooth.

The pH of the bath is preferably 11 or higher, and more preferably 12.5 or higher. The bath temperature is preferably 60° C. or higher, and more preferably 80° C. or higher.

The hardness of the electrodeposit may sometimes be increased by recrystallization, if it is subjected to heat treatment as a post-treatment.

It is also possible to melt the ground metal and use the resulting metal layer as a film.

The platinum alloy electrodeposition bath and the process for manufacturing a platinum alloy electrodeposited product using the same according to tile present invention is as described above. Thus, not only the cost of ground metal can be reduced by using the platinum alloy, but also luster and high hardness, which are the properties unattainable by use of a pure platinum plating bath or pure platinum electroforming bath, can be imparted to the deposit film.

The followings are descriptions of preferable embodiments according to the present invention.

| First Embodiment: | |
|---|---|
| (1) Electrodeposition bath composition | |
| $K_2Pt(OH)_6$ | 10 g/lit. (in terms of Pt) |
| ZnO alkaline solution | 0.2 g/lit. (in terms of Zn) |
| KOH | 60 g/lit. |
| (2) Operational condition | |
| Current density | 1 A/dm$^2$ |
| Temperature | 90° C. |
| Electrodeposition time | 120 min. |
| (3) Result | |

A lustrous product with approximate 17-μm thickness of platinum zinc alloy was obtained. The Pt purity of the lustrous product was 96%.

| Second Embodiment: | |
|---|---|
| (1) Electrodeposition bath composition | |
| $K_2Pt(OH)_6$ | 10 g/lit. (in terms of Pt) |
| $K_2SnO_3.3H_2O$ solution | 15 g/lit. (in terms of Sn) |
| KOH | 20 g/lit. |
| (2) Operational condition | |
| Current density | 2 A/dm$^2$ |
| Temperature | 90° C. |
| Electrodeposition time | 240 min. |
| (3) Result | |

A semilustrous product of platinum-tin alloy with approximate 30-μm thickness was obtained. The Vickers hardness was found to be 600 to 850 Hv. The Pt purity of the semi lustrous product was 85%.

| Third Embodiment: | |
|---|---|
| (1) Electrodeposition bath composition | |
| $K_2Pt(OH)_6$ | 20 g/lit. (in terms of Pt) |
| $Pd(NH_3)_4(OH)_2$ | 0.3 g/lit. (in terms of Pt) |
| KOH | 30 g/lit. |
| (2) Operational condition | |
| Current density | 3 A/dm$^2$ |
| Temperature | 90° C. |
| Electrodeposition time | 120 min. |
| (3) Result | |

A nonlustrous product platinum-palladium alloy layer with approximate 50-μm thickness was obtained. After the ground metal was melted, the deposit film was subjected to heat treatment at 350° C. for 2 hours in $N_2$ atmosphere. Thus, a flexible foil of Pt/Pd alloy was obtained. The Pt purity of the foil was 90%.

What is claimed is:

1. A platinum alloy electrodeposition bath comprising 2 to 100 g/lit. of platinum in tile form of $Pt(OH)_6^{2-}$ complex ion and at least one ion of Sn, Zn and Pd in an amount of 1 mg/lit or more.

2. The platinum alloy electrodeposition bath according to claim 1, wherein the at least one ion of Sn, Zn and Pd is present in an amount of 50 mg/lit. to 100 g/lit.

3. The platinum alloy electrodeposition bath according to claim 1, wherein the Sn ion is present in the form of sodium stannate or potassium stannate.

4. The platinum alloy electrodeposition bath according to claim 1, wherein the Sn ion is present in the form of $Sn(OH)_6^{2-}$.

5. The platinum alloy electrodeposition bath according to claim 1, wherein the Zn ion is present in the form of zinc oxide.

6. The platinum alloy electrodeposition bath according to claim 1, wherein the Zn ion is present in the form of $Zn(OH)_3^-$ or $Zn(OH)_4^{2-}$.

7. The platinum alloy electrodeposition bath according to claim 1, wherein the Pd ion is present in the form of $Pd(NH_3)_4Cl_2$, $Pd(NH_3)_2Cl_2$ or $Pd(NH_3)_4(OH)_2$.

8. The platinum alloy electrodeposition bath according to claim 1, wherein the Pd ion is present in the form or $[Pd(NH_3)_2]^{2+}$, $[Pd(NH_3)_2X_4]^{2-}$ or $[Pd(NH_3)_4]^{2+}$ (wherein X is a monovalent anion).

9. The platinum alloy electrodeposition bath according to claim 8, wherein the bath further contains at least one or amidosulfuric acid, sodium amidosulfate and potassium amidosulfate.

10. The platinum alloy electrodeposition bath according to claim 1, wherein the bath further contains a carboxylic acid or a carboxylic acid alkali metal salt.

11. The platinum allow electrodeposition bath according to claim 1 wherein Pd is present in the form of $[Pd(NH_3)_n]^{2+}$ (wherein n is equal to 2 or 4).

12. In a process for manufacturing a platinum alloy product by electrodepositing platinum alloys upon the surface of an object, the improvement which comprises using an electrodeposition bath comprising 2 to 100 g/lit. of platinum in the form of $Pt(OH)_6^{2-}$ complex ion and at least one of Sn, Zn and Pd in an amount of 1 mg/lit. or more.

13. An electrodeposition process according to claim 12 wherein, during the process, the pH of the bath is 11 or higher and the bath temperature is 60° C. or higher.

14. An electrodeposition process according to claim 12 wherein the process is carried out using a pulse power source as the source of electrical current for such process.

* * * * *

UNITED STATES PATENT AND TRADEMARK OFFICE

CERTIFICATE OF CORRECTION

PATENT NO. : 5,421,991
DATED : June 6, 1995
INVENTOR(S) : S. Yarita

It is certified that error appears in the above-indentified patent and that said Letters Patent is hereby corrected as shown below:

At Column 3, line 26, change "tile" to read —the—.

At Column 3, line 28, change "mg/lit" to read —mg/lit.—.

At Column 4, line 16, change "or" to read —of—.

Signed and Sealed this

Fifth Day of September, 1995

*Attest:*

Bruce Lehman

BRUCE LEHMAN

*Attesting Officer*

*Commissioner of Patents and Trademarks*